US005510415A

United States Patent [19]

Zahrobsky et al.

[11] Patent Number: 5,510,415

[45] Date of Patent: Apr. 23, 1996

[54] INK JET COMPOSITION FOR PRINTING ON TEXTILES

[75] Inventors: Peter Zahrobsky, Glen Ellyn; Bruce Lent, Oak Park, both of Ill.

[73] Assignee: Videojet Systems, Inc., Wood Dale, Ill.

[21] Appl. No.: 232,496

[22] Filed: Apr. 25, 1994

[51] Int. Cl.[6] ..... C08L 83/04; C08L 35/06; C09D 11/10

[52] U.S. Cl. ..... 524/506; 524/539; 106/20 D; 106/20 R; 523/160

[58] Field of Search ..... 524/497, 506, 524/539; 523/160, 161; 106/20 R, 21 A, 23 R, 20 D

[56] References Cited

U.S. PATENT DOCUMENTS

| | | | |
|---|---|---|---|
| 4,365,035 | 12/1982 | Zabiak | 523/160 |
| 4,369,279 | 1/1983 | Emerick | 524/445 |
| 4,446,259 | 5/1984 | Vasta | 524/506 |
| 4,567,213 | 1/1986 | Bhatia et al. | 523/160 |
| 4,689,049 | 8/1987 | Burke et al. | 8/552 |
| 4,702,742 | 10/1987 | Iwata et al. | 106/20 R |
| 4,716,188 | 12/1987 | Mariusson et al. | 524/506 |
| 4,725,849 | 2/1988 | Koike et al. | 427/261 |
| 4,849,770 | 7/1989 | Koike et al. | 106/20 R |
| 4,969,951 | 11/1990 | Koike et al. | 106/20 R |

FOREIGN PATENT DOCUMENTS

| | | | |
|---|---|---|---|
| 0071345A2 | 2/1983 | European Pat. Off. . | |
| 0604105A1 | 6/1994 | European Pat. Off. . | |
| 2385782 | 3/1978 | France . | |
| 0029677 | 2/1982 | Japan | 524/506 |
| 0133172 | 8/1982 | Japan | 523/161 |
| 0180563 | 10/1983 | Japan | 524/506 |
| 60-092368 | 5/1985 | Japan . | |
| 0086182 | 5/1985 | Japan | 524/506 |
| 0086183 | 5/1985 | Japan | 524/506 |
| 61-016884 | 1/1986 | Japan . | |
| 61-213273 | 9/1986 | Japan . | |
| 62-225577 | 10/1987 | Japan . | |
| 62-231787 | 10/1987 | Japan . | |
| 2189373 | 7/1990 | Japan . | |
| 0730771 | 5/1980 | U.S.S.R. | 524/506 |
| 1603062 | 11/1981 | United Kingdom . | |
| 2088402 | 6/1982 | United Kingdom . | |

OTHER PUBLICATIONS

Database WPI, Derwent Publication Ltd. (82–45491E, Abstract).

Database Patent Abstracts of Japan (JP6128513, Abstract).

*Primary Examiner*—Peter A. Szekely
*Attorney, Agent, or Firm*—Leydig, Voit & Mayer, Ltd.

[57] ABSTRACT

A jet ink composition for use with textiles which comprises a pigment dispersed with an acrylic resin, a silicone resin, and at least one non-aqueous solvent. The printed images formed therefrom resist subsequent dying and remain readable even after being subjected to dark-colored dyes.

25 Claims, No Drawings

INK JET COMPOSITION FOR PRINTING ON TEXTILES

FIELD OF THE INVENTION

This invention relates to the field of ink-let printing, particularly to ink jet printing on textiles, and more particularly, to a new ink jet ink composition that resists dyeing for use in textile applications.

BACKGROUND OF THE INVENTION

Marking methods such as roller printing, screen printing, transfer printing, and stitching or sewing of messages have been used for marking textiles such as woven fabrics, non-woven fabrics, and blended woolen fabrics. However, these conventional methods are expensive and slow, because they require special preparation of the fabric and/or additional manufacturing steps. Therefore, these methods are not economical.

The use of ink jet printing has been proposed as a more economical and flexible method. Because ink jet printing could be done "in-line," it would not slow the production process.

Ink jet printing is a well-known technique by which printing is accomplished without contact between the printing device and the substrate on which the printed characters are deposited. Briefly described, ink jet printing involves the technique of projecting a stream of ink droplets to a surface and controlling the flight of the droplets electronically so that they are directed to form the desired printed image on that surface. This technique of non-contact printing is particularly well suited for application of characters onto irregularly shaped surfaces, including, for example, the curved bottom of beverage containers.

In general, an ink jet composition must meet certain rigid requirements to be useful in ink jet printing operations. These relate to viscosity, resistivity, solubility, compatibility of components and wettability of the substrate. Further, the ink must be quick-drying and smear resistant, must be capable of passing through the ink jet nozzle without clogging, and must permit rapid clean-up of the machine components with minimum effort.

Ink jet printing, however, also has several drawbacks. The quality of the print tends to be impaired due to blotting on the cloth, partly because the ink jet printer does not allow the use of an ink having high viscosity and partly because cloth usually has a more uneven texture than paper, thus making it difficult to print patterns of minute or delicate design. In addition, discharge of the ink tends to be unstable, and the response to high frequency is liable to be impaired depending on the physical property of the ink, owing to the fact that the ink has to be discharged through minute nozzles at high velocity and high frequency. Further, print formed using a conventional ink jet formulation exhibits a slow dye-fixing rate and minimal washing fastness.

Certain ink jet formulations and methods of using them have been proposed to eliminate these problems. U.S. Pat. No. 4,702,742 relates to a method of applying an aqueous dye containing an ink on cloth that has been previously treated with an ink acceptor. The ink is then optionally subjected to a dye-fixing treatment.

U.S. Pat. No. 4,725,849 discloses a process of ink jet printing comprising applying an aqueous dye-containing ink to a cloth that has been pre-treated with an ink receiving material having a viscosity of 1000 centipoises. The ink receiving material may be a water soluble resin-containing solution or a hydrophilic resin-containing solution.

U.S. Pat. No. 4,849,770 relates to an ink jet formulation comprising a reactive dye or reactive dispersing dye, and a solvent composed mainly of water and an organic solvent non-reactive with the dye. This formulation is applied via ink jet printing to a textile, and is then subjected to a dye-fixing treatment.

U.S. Pat. No. 4,969,951 discloses an ink jet formulation comprising a reactive disperse dye and a solvent composed of water, or water and a water-soluble organic solvent. This formulation is applied via ink-jet printing to a textile, and is then subjected to a dye-fixing treatment.

Japanese Patent No. 62225577 relates to an ink jet composition for textile printing operations comprising a pigment, a water-soluble or aqueous dispersible polyester or polyamide, a cross-linking agent, and water.

Japanese Patent No. 61213273 discloses an ink jet composition for use with polyester fibers comprising a water-insoluble pigment, dispersant consisting of a 3:1 ratio of aromatic rings to sulfonate or sulphuric ester group.

Japanese Patent No. 62231787 relates to a method of textile printing using an ink jet composition comprising a pigment and a water-soluble or dispersable polyester or polyamide. The textile to be printed is first treated with a metal salt or cationic compound. The ink is then applied, and is cross-linked by a cross-linking agent present either in the ink or on the textile.

Japanese Patent No. 2189373 discloses an ink jet composition for textile printing operations comprising water-insoluble pigment having particles with a diameter of 0.03–1.0 microns, and a dispersion media, wherein the solution density is 1,010–1,300.

The aforementioned ink compositions and methods of using them also suffer from several drawbacks. First, in some instances it is necessary to pre-treat the textile prior to application of the ink to prevent spreading or blotting. Other of the above-noted patents require chemical fixing treatments after the ink has been applied. Further, all of the aforementioned ink formulations and methods relate to dark-colored inks for use on white textiles, or white textiles that are dyed light or pastel colors. These inks are not visible if after the application of the ink, the textile is dyed a dark color, such as navy blue, maroon, or black.

Therefore, to date there has been no white or pastel-colored ink formulation for ink jet printing on textiles that resists dark-colored dyes, so that the message printed with that ink is visible after the fabric is dyed with a dark-colored dye. There exists a need for such inks in the industry. Currently, fabrics are coded with brand names, sizes, or color information after the dying process. This separate step, which is currently accomplished by stitching or contact printing, is inefficient, because it slows down production. If the product coding is obtained through a subsequent dying step, the utility of marking such information is lost. This is a particular problem when fabric, especially hosiery fabric, is subjected to dark dyes.

SUMMARY OF THE INVENTION

The present invention overcomes the problems associated with prior art ink compositions for ink jet printing on undyed textiles, and achieves distinct advantages thereover. In accordance with one aspect of the present invention, an ink jet ink composition is provided comprising a pigment dispersed with an acrylic resin, a silicone resin, and at least one non-aqueous solvent in which the pigment dispersion and silicone resin are dissolved and/or dispersed. It is now possible to formulate ink jet ink compositions for printing on textiles that have good adherence to a variety of textiles, and that form printed images that resist dyeing when the textile is dyed after application of the ink.

The ink compositions of the present invention may also comprise, and preferably do comprise, in addition to the three components mentioned above, a dispersant, a plasticizer, and an electrolyte.

DETAILED DESCRIPTION OF PREFERRED EMBODIMENT

Pigment

The pigment used in the present invention should have a color that contrasts with the substrate to which it is to be applied, or with the color of the dye to be applied to the textile after ink jet printing. The maximum particle size of the pigment should also be less than about 1 micron in diameter. The preferred pigment for use in the inks of the present invention is titanium dioxide.

In order to obtain pigment particles of useful size for incorporation into an ink jet ink, pigment is ground with a non-reactive binder resin which separates pigment particles and prevents them from coalescing via electrostatic interaction. The resultant solid/solid dispersion, referred to as pigment "chip" maintains pigment particle size until the pigment is ready to be incorporated into the ink. The ratio of pigment to binder resin in the supplied chip is usually about 1:1 to 9:1, with a preferred ratio of about 70% pigment to 30% binder resin by weight of the chip. Useful binder resins for the inks of the current invention include acrylic, vinyl, modified rosin ester, or ethyl cellulose. Useful pigments include organic pigments, aluminum silicate, or titanium dioxide. The preferred chip in the ink of current invention contains titanium dioxide pigment and acrylic binder resin. This chip is available under the trade name Acroverse 91W135C, from Penn Color, Inc. The acrylic resin in Acroverse 91W135C is available under the trade name Joncryl 678, from S.C. Johnson Wax.

During formulation of the ink composition of the present invention, chip binder resin is dissolved by the solvent. The pigment is preferably kept from agglomeration by a dispersing agent. It is believed that the dispersing agent chemically binds with pigment particles creating a steric shield around each particle and stabilizing the solid/liquid dispersion of the ink. The dissolved binder resin, along with each of the other resins added, aids in maintaining the solid/liquid ink dispersion by increasing bulk solution viscosity which, in turn, reduces particle settling.

The pigment typically is present in an amount from about 3% to about 20% by weight of the ink composition. Preferably, from about 12% to about 15% of pigment by weight of the ink composition should be present.

Silicone Resin

The silicone resin binds the pigment to the substrate, disperses the pigment, and causes the printed images formed from the ink to resist being dyed. It is dissolved in the ink composition. The preferred silicone resin is diphenyl, methyl, phenyl, phenyl methyl silicone, available under the trade name DC6-2230 from Dow Corning.

The silicone resin typically is present in an amount from about 3% to about 30% by weight of the ink composition, with from about 5% to about 13% by weight being preferred.

Solvent

The solvent dissolves and/or suspends the ink components, and keeps the ink composition in a fluid state so that the ink will flow readily through the head of the ink jet printing device. Solvents useful in the ink compositions of the present invention include alcohols and ketones, which may be used alone or in admixture. Particularly useful are ethanols denatured with isopropanol and n-propyl acetate. The preferred denatured ethanol is available as Duplicating Fluid 100C.NPA from Petro Products. The solvent system should be non-aqueous, that is, containing not more than about 5% water.

The solvent typically is present in an amount from about 40% to about 95% by weight of the ink composition, with an amount from about 60% to about 65% by weight being preferred.

Other Components

An electrolyte can also be used in the ink compositions of the present invention to ensure that the ink composition has suitable electrical conductivity, especially if the ink is to be used in continuous ink jet printing. The electrolyte is usually an inorganic salt or potassium thiocyanate, with potassium thiocyanate or lithium nitrate being preferred. The electrolyte usually is present in an amount up to about 3% by weight of the ink composition, with an amount up to about 1.5% being preferred.

In addition, a dispersing agent can be present in the ink composition of the present invention to provide increased dispersion of pigment particles, such as titanium dioxide particles. Preferred dispersing agents are BYK-P-104S (a high molecular weight unsaturated polycarboxylic acid/polysiloxane copolymer solution, available from BYK Chemie USA, Anti-Terra-U, a solution of a salt of unsaturated polyamine amides and higher molecular weight acidic esters, also available from BYK Chemie USA, and Nopcosperse, available from Henkel Corp. The dispersing agent usually is present in an amount up to about 1.5% by weight of the ink composition, with an amount up to about 0.5% being preferred.

Further, a plasticizer, such as Santicizer 8 (N-ethyl-o,p-Toluenesulfonamide), available from Monsanto, may be used to soften the resin component of the ink, so that the ink does not "flake off" the substrate after application. The plasticizer usually is present in an amount up to about 3% by weight of the ink composition, with an amount up to about 1.5% being preferred.

The present invention may also comprise other additives, which may be any substance that can enhance the ink composition with regard to (a) improved solubility of other components, (b) improved adhesion of the ink to the substrate, (c) improved print quality, and (d) control of wetting characteristics, which may be related to such properties as surface tension and viscosity, among other properties.

For example, antioxidants and/or UV light stabilizers also be used in combination or separately. Useful antioxidants include hindered phenols, such as BHT, TBHQ, and BHA, which are sold under the trade names Tenox (Eastman Chemical Products), Ethanox (Ethyl Corp.), and Irgazox (Ciba-Geigy). Light stabilizers for ultraviolet and visible light include hindered amines such as Tinuvin 770, 765, and 622, and substituted benzotrioles such as Tinuvin P326, 327, and 328, all of which are available from Ciba-Geigy. Also, substituted benzophenones Cyasorb UV-531, UV-24, and UV-9, available from American Cyanamid Co. can be used.

General Considerations

The viscosity of the ink compositions of the present invention is generally from about 2 to about 8 centipoises, and preferably is from about 4.0 to about 5.5 centipoises.

The viscosity of a given ink composition can be adjusted depending on the specific components used therein, and such adjustment is with the skill of those in the art.

Printed images may be generated with the ink compositions of the present invention by incorporating the inks into a continuous or drop-on-demand ink jet printer, and causing droplets of the ink to be ejected in an imagewise pattern onto a substrates such as textiles. Suitable printers for employing the ink compositions of the present invention include commercially available ink jet printers.

The formulated jet inks of the present invention will exhibit the following characteristics: (1) a viscosity from about 2 to about 8 centipoises (cps) at 25° C., (2) an electrical resistivity from about 50 to about 2,000 ohms-$cm^{-1}$, (3) a sonic velocity from about 1,200 to about 2,000 m/sec., (4) a surface tension below 28 dynes/cm, (5) a pH in the range of from about 3 to about 9, and (6) a specific gravity from about 0.8 to about 1.1.

The ink compositions of this invention can be applied to a wide range of white textiles prior to those textiles being dyed. However, the invention is of special use in forming images on white Nylon hosiery prior to that hosiery being dyed.

When the ink compositions of the present invention are applied to white textiles prior to those textiles being dyed, the image formed by the ink will remain visible even after the textile is exposed to a standard dyeing process. After dyeing, the ink will appear as white or pastel colored, because it repels the dye, whereas the rest of the textile accepts the dye. The print color contrast of the ink with the dyed textile can be enhanced by pre-treating the textile with water, and/or post treating the dyed textile with heat.

The present invention is further illustrated by the following examples.

| Material | % By Weight |
|---|---|
| Duplicating Fluid 100C.NPA | 63.7 |
| BYK-P-104S Dispersant | 0.3 |
| DC 6-2230 Silicone Resin | 13.0 |
| Acroverse 91W135C Chip | 20.0 |
| Santicizer 8 | 1.5 |
| Potassium Thiocyanate | 1.5 |
| | 100.0 |

An ink containing the above components was formulated as follows: The silicone resin was added to approximately one-fourth (¼) of the total Duplicating Fluid 100C.NPA to be used. BYK-P-104S dispersant was next added, followed by the Acroverse 91W135C Chip, followed by the addition of Santicizer 8. After each addition, the solution was mixed until the added component was dissolved or dispersed. After the Santicizer 8 was added, the solution was mixed at high speed, using a dispersion blade, for 60 minutes. The remainder of the Duplicating Fluid 100C.NPA was added followed by the potassium thiocyanate. Again, the ink was mixed after each addition. After addition of the potassium thiocyanate, the ink was filtered and bottled. The ink made according to the above procedure had a viscosity of 5.3 centipoises, a resistivity of 720 ohms-cm, a specific gravity of 0.99, a pH of 4.4, and a surface tension of 23.4 dynes/cm. The ink was then used to print a message on undyed white nylon hosiery and the hosiery was subsequently dyed black. The resulting message was white, and exhibited excellent color contrast and stability.

EXAMPLE 2

As a comparison, an ink containing no silicone resin was formulated and tested. Its composition was as follows:

| Material | % By Weight |
|---|---|
| 50% BKS-7570 (in MEK) (phenolic resin in solution) | 30.0 |
| BYK-P-104S | 0.3 |
| Acroverse 91W135C Chip | 22.0 |
| Santicizer 8 | 1.0 |
| SDA-35A (100 parts ethanol denatured with 5 parts ethyl acetate) | 40.4 |
| KSCN | 1.3 |
| 10% Silwet L-7001 (in SDA-35A) (surfactant in solution) | 5.0 |
| | 100.0 |

The ink was formulated in the same manner as that of Example 1, with the components being added in the order listed. After the addition of the Santicizer 8, the ink was mixed at high speed, using a dispersion blade, for 60 minutes.

The resulting ink had a viscosity of 4.5 centipoises, a resistivity of 750 ohms-cm, a specific gravity of 1.0, and a pH of 4.4. The ink was used to print a message on undyed white hosiery, and the hosiery was then dyed black. The resulting message was inferior to that generated by the ink of Example 1, both in terms of color contrast and stability.

We claim:

1. An ink jet ink composition for use with textiles, comprising a pigment dispersed with an acrylic resin, from about 3% to about 30% silicone resin by weight of the ink composition, and at least one non-aqueous solvent, where the ink composition has a viscosity from about 2 to about 8 centipoises at 25° C., an electrical resistivity from about 50 to about 2000 ohms-cm–1, and a sonic velocity from about 1,200 to about 2,000 m/sec, and where the ink composition contains less than about 5% water by weight of the ink composition.

2. The ink composition of claim 1, wherein the pigment is titanium dioxide.

3. The ink composition of claim 2, wherein the titanium dioxide is present in an amount from about 3% to about 20% by weight of said ink composition.

4. The ink composition of claim 1, wherein the silicone resin is diphenyl, methyl, phenyl, phenyl methyl silicone.

5. The ink composition of claim 1, wherein the solvent is selected from the group consisting of alcohols and ketones.

6. The ink composition of claim 1, wherein the acrylic resin is a styrene acrylic polymer.

7. The ink composition of claim 1, additionally comprising a dispersant.

8. The ink composition of claim 7, additionally comprising an electrolyte selected from the group consisting of potassium thiocyanate and inorganic salts.

9. The ink composition of claim 8, additionally comprising a plasticizer.

10. An ink jet ink composition for use with textiles, comprising a pigment, an acrylic resin, from about 3% to about 30% silicone resin by weight of the ink composition, and at least one non-aqueous solvent, where the ink composition has a viscosity from about 2 to about 8 centipoises at 25° C., an electrical resistivity from about 50 to about 2000 ohms-cm–1, and a sonic velocity from about 1,200 to about 2000 m/sec, and where the ink composition contains less than about 5% water by weight of the ink composition.

11. The ink composition of claim 10, wherein the pigment is titanium dioxide.

12. The ink composition of claim 10, wherein the acrylic resin is a styrene acrylic polymer.

13. The ink composition of claim 10, wherein the silicone resin is diphenyl, methyl, phenyl, phenyl methyl silicone.

14. An ink jet ink composition for use in ink jet printing of textiles, comprising titanium dioxide dispersed with an acrylic resin, a silicone resin, a dispersant, an electrolyte selected from the group consisting of potassium thiocyanate and inorganic salts, and a plasticizer, and at least one non-aqueous solvent, wherein the weight ratio of acrylic resin to titanium dioxide is approximately 3:7 and the titanium dioxide is present in an amount from about 3% to about 20% by weight of said ink composition, said silicone resin is present in an amount from about 3% to about 30% by weight of said ink composition, said dispersant is present in amount less than about 1.5% by weight of said ink composition, said electrolyte is present in an amount less than about 3.0% by weight of said ink composition, said plasticizer is present in an amount less than 3.0% by weight of said ink composition, and said non-aqueous solvent is present in an amount from about 40% to about 95% by weight of such ink composition, where said ink composition has a viscosity from about 2 to about 8 centipoises at 25° C., an electrical resistivity from about 50 to about 2000 ohms-$cm^{-1}$, and a sonic velocity from about 1,200 to about 2,000 m/sec and where the ink composition contains less than 5% water by weight of the ink composition.

15. The ink composition of claim 14, wherein said silicone resin is diphenyl, methyl, phenyl, phenyl methyl silicone.

16. The ink composition of claim 14, wherein the acrylic resin is a styrene acrylic polymer.

17. The ink composition of claim 14, wherein said electrolyte is potassium thiocyanate.

18. The ink composition of claim 11, wherein the titanium dioxide is present in an amount from about 3% to about 20% by weight of the ink composition.

19. The ink composition of claim 10, wherein the solvent is selected from the group consisting of alcohols and ketones.

20. The ink composition of claim 10, additionally comprising a dispersant.

21. The ink composition of claim 20, additionally comprising an electrolyte selected from the group consisting of potassium thiocyanate and inorganic salts.

22. The ink composition of claim 21, additionally comprising a plasticizer.

23. An ink jet ink composition for use in ink jet printing of textiles, comprising titanium dioxide, an acrylic resin, a silicone resin, a dispersant, an electrolyte selected from the group consisting of potassium thiocyanate and inorganic salts, and a plasticizer, and at least one non-aqueous solvent, wherein the weight ratio of acrylic resin to titanium dioxide is approximately 3:7 and the titanium dioxide is present in an amount from about 3% to about 20% by weight of said ink composition, said silicone resin is present in an amount from about 3% to about 30% by weight of said ink composition, said dispersant is present in amount less than about 1.5% by weight of said ink composition, said electrolyte is present in an amount less than about 3.0% by weight of said ink composition, said plasticizer is present in an amount less than 3.0% by weight of said ink composition, and said non-aqueous solvent is present in an amount from about 40% to about 95% by weight of such ink composition, where said ink composition has a viscosity from about 2 to about 8 centipoises at 25° C, an electrical resistivity from about 50 to about 2000 ohms-$cm^{-1}$, and a sonic velocity from about 1,200 to about 2,000 m/sec, and where the ink composition contains less than about 5% water by weight of the ink composition.

24. The ink composition of claim 23, wherein the acrylic resin is a styrene acrylic polymer.

25. The ink composition of claim 23, wherein the electrolyte is potassium thiocyanate.

* * * * *